US009826781B1

(12) United States Patent
Zhu

(10) Patent No.: US 9,826,781 B1
(45) Date of Patent: Nov. 28, 2017

(54) E-LIQUID FLOW CONTROL MECHANISM AND ELECTRONIC CIGARETTE HAVING THE SAME

(71) Applicant: Xiaochun Zhu, Shenzhen (CN)

(72) Inventor: Xiaochun Zhu, Shenzhen (CN)

( * ) Notice: Subject to any disclaimer, the term of this patent is extended or adjusted under 35 U.S.C. 154(b) by 0 days.

(21) Appl. No.: 15/249,465

(22) Filed: Aug. 28, 2016

(51) Int. Cl.
*A24F 47/00* (2006.01)
*F16K 3/02* (2006.01)

(52) U.S. Cl.
CPC ..... *A24F 47/008* (2013.01); *F16K 3/0209* (2013.01); *F16K 3/0254* (2013.01)

(58) Field of Classification Search
CPC .... A24F 47/008; A24F 47/002; A24F 47/004; A24F 15/18; A24F 15/12; A24F 15/14; A24F 1/30; A24F 13/02; A24F 13/06; A24F 47/00; A24F 7/02; A24F 13/04; A24F 13/10; A24F 1/14; A24F 7/04
See application file for complete search history.

(56) References Cited

U.S. PATENT DOCUMENTS 8,991,402 B2 * 3/2015 Bowen ..... A61M 11/041 131/194
2015/0027470 A1 * 1/2015 Kane ..... A24F 47/008 131/329
2015/0027475 A1 * 1/2015 Jarriault ..... A24D 3/048 131/329
2015/0257447 A1 * 9/2015 Sullivan ..... A24F 47/008 131/329
2015/0335071 A1 * 11/2015 Brinkley ..... F22B 1/284 131/328
2016/0135501 A1 * 5/2016 Liu ..... A24F 47/002 131/329
2017/0099878 A1 * 4/2017 Murison ..... A24F 47/008
2017/0112192 A1 * 4/2017 Shan ..... A24F 47/008
2017/0119053 A1 * 5/2017 Henry, Jr. ..... A24F 47/008

* cited by examiner

*Primary Examiner* — Truc Nguyen
(74) *Attorney, Agent, or Firm* — Ming Jiang

(57) ABSTRACT

The present disclosure relates to an E-liquid flow control mechanism and electronic cigarettes having the E-liquid flow control mechanism. The electronic cigarette may include: an electronic cigarette body, a vaporizer, and an E-liquid flow control mechanism. Electronic cigarette body includes an E-liquid storage tank, a mouthpiece, and an electronic cigarette base. The vaporizer having a heating element, and an E-liquid storage medium, is positioned on a vaporizer base. The E-liquid flow control mechanism defines an E-liquid flow control opening, and has an E-liquid flow control handle. When the E-liquid flow control handle is lifted all the way up, the E-liquid flow is blocked. When the E-liquid flow control handle is pushed all the way down, the E-liquid flow reaches maximum. When the E-liquid flow may be controlled by a user by pushing down or pulling up the E-liquid flow control handle between the highest point and the lowest point.

19 Claims, 6 Drawing Sheets

E-LIQUID FLOW CONTROL MECHANISM AND ELECTRONIC CIGARETTE HAVING THE SAME

FIELD

The present disclosure generally relates to the field of electronic cigarette, and more particularly to an E-liquid flow control mechanism and electronic cigarettes having the E-liquid flow control mechanism.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

It is well known that smoking cigarette is harmful to smoker's health. The active ingredient in a cigarette is mainly nicotine. During smoking, nicotine, along with tar aerosol droplets produced in the cigarette burning, are breathed into the alveolus and absorbed quickly by the smoker. Once nicotine is absorbed into the blood of the smoker, nicotine then produces its effect on the receptors of the smoker's central nervous system, causing the smoker relax and enjoy an inebriety similar to that produced by an exhilarant.

The electronic cigarette is sometimes referred as electronic vaporing device, personal vaporizer (PV), or electronic nicotine delivery system (ENDS). It is a battery-powered device which simulates tobacco smoking. It generally uses a heating element that vaporizes a liquid solution (e-liquid). Some solutions contain a mixture of nicotine and a variety of flavorings, while others release a flavored vapor without nicotine. Many are designed to simulate smoking experience, such as cigarette smoking or cigar smoking. Some of them are made with similar appearance, while others are made considerably different in appearance.

When E-liquid is filled in an electronic cigarette before shipment out of a factory, the E-liquid is always in contact with an E-liquid storage medium, and exposed to air causing vaporization. The oxidation of the E-liquid may cause certain bad smell or bad taste with users. Therefore, it is desirable to have an E-liquid flow control mechanism to separate the E-liquid from the E-liquid storage medium when the electronic cigarette is not in use. Additionally, it is also desirable to allow user to control E-liquid flow when the electronic cigarette is in use.

Therefore, an unaddressed need exists in the art to address the aforementioned deficiencies and inadequacies.

SUMMARY

In one aspect, the present disclosure relates to an electronic cigarette. In certain embodiments, the electronic cigarette may include: an electronic cigarette body, a vaporizer, and an E-liquid flow control mechanism. The electronic cigarette body includes an E-liquid storage tank for storing E-liquid. The electronic cigarette body also includes a mouthpiece positioned on a top end of the electronic cigarette body, and an electronic cigarette base positioned at a bottom end of the electronic cigarette body. The vaporizer is positioned on a vaporizer base. The vaporizer includes a heating element, and an E-liquid storage medium.

In certain embodiments, when the E-liquid flow control handle is lifted all the way up to a first point, the E-liquid in the E-liquid storage tank is blocked by the E-liquid flow control mechanism. When the E-liquid flow control handle is pushed all the way down to a second point, the E-liquid in the E-liquid storage tank flows into the vaporizer to be vaporized. When the E-liquid flow control handle is pushed down to a point between the first point and the second point, the E-liquid flow between the E-liquid storage tank and the E-liquid storage medium is controlled.

In certain embodiments, the E-liquid storage medium may include: an "L" shaped the exterior wall facing the E-liquid flow control opening to receive the E-liquid from the E-liquid storage tank, and a cylindrical center for installing the heating element.

In certain embodiments, the electronic cigarette base may include a separation wall configured to separate the E-liquid storage tank and the vaporizer. The separation wall defines an E-liquid flow opening configured to supply the E-liquid in the E-liquid storage tank to the E-liquid storage medium through the E-liquid flow opening.

In certain embodiments, the "L" shaped the exterior wall of the E-liquid storage medium is positioned at the E-liquid flow opening to prevent the E-liquid in the E-liquid storage tank from spilling out through the vaporizer.

In certain embodiments, when the E-liquid flow control handle is pushed down to a first point, the E-liquid flow control opening of the E-liquid flow control mechanism overlaps the E-liquid flow opening partially to allow E-liquid in the E-liquid storage tank to flow to the E-liquid storage medium. When the E-liquid flow control handle is pushed down to a second point, the E-liquid flow control opening of the E-liquid flow control mechanism overlaps the E-liquid flow opening entirely to allow maximum E-liquid flow from the E-liquid storage tank to the E-liquid storage medium.

In certain embodiments, the first point and the second point are marked on the E-liquid flow control mechanism such that a user uses the first point and the second point to perform E-liquid flow control.

In certain embodiments, the electronic cigarette body defines a first air intake opening and a second air intake opening and forms an airflow path. When the user pushes down the E-liquid flow control handle of the E-liquid flow control mechanism to allow the E-liquid in the E-liquid storage tank to flow into the E-liquid storage medium, turns on an electrical power supply and sucks from the mouthpiece, outside air flows through the first air intake opening and the second air intake opening into an air intake path, goes down to the E-liquid storage medium and the heating element, goes up through a vapor output path, and finally exits from a vapor output tube of the mouthpiece.

In certain embodiments, the heating element includes a positive terminal electrically coupled to a positive terminal of the electrical power supply through a positive terminal of the electronic cigarette base, and a negative terminal electrically coupled to a negative terminal of the electrical power supply through a negative terminal of the electronic cigarette base.

In certain embodiments, the E-liquid storage medium includes: cotton fibers, polypropylene fibers, terylene fibers, nylon fibers, and porous ceramic materials. The heating element may include: a grid shaped heating element, a mesh shaped heating element, a net shaped heating element, a spiral heating element, and any combination of these heating elements.

In certain embodiments, the electronic cigarette body is slidedly coupled to the electronic cigarette base. A sealing band is used to seal the connection between the electronic cigarette body and the electronic cigarette base.

In certain embodiments, an E-liquid flow control mechanism base is installed at a lower end of the E-liquid flow control mechanism to prevent the E-liquid flow control mechanism from being pulled out of the electronic cigarette body.

In one embodiment, the E-liquid storage tank may be a disposable E-liquid storage tank. In another embodiment, the E-liquid storage tank may be a refillable E-liquid storage tank.

In another aspect, the present disclosure relates to a method of using an electronic cigarette. In certain embodiments, the method may include: pushing down, by a user, an E-liquid flow control handle of an E-liquid flow control mechanism to allow an E-liquid flow control opening of the E-liquid flow control mechanism to partially overlap an E-liquid flow opening defined on a separation wall of an electronic cigarette base to allow E-liquid stored in an E-liquid storage tank to flow to an E-liquid storage medium, turning on, by the user, an electrical power supply to provide electrical power to a heating element of a vaporizer to vaporize the E-liquid flowed to the E-liquid storage medium, and sucking, by the user, E-liquid vapor from the vaporizer through a mouthpiece. Air outside of the electronic cigarette enters an electronic cigarette body through one or more air intake openings, an air intake path. Then the air is be vaporized by the vaporizer, and the vapor formed by the vaporizer exits through a vapor output path and the mouthpiece.

In one embodiment, the E-liquid storage tank may be a disposable E-liquid storage tank filled with E-liquid. In another embodiment, the E-liquid storage tank may be a refillable E-liquid storage tank configured to be refilled when the E-liquid in the refillable E-liquid storage tank becomes low.

In certain embodiments, a first point and a second point are marked on the E-liquid flow control mechanism such that the user uses the first point and the second point to perform E-liquid flow control.

In certain embodiments, when the user wishes to put the electronic cigarette in an airplane mode, the user pulls the E-liquid flow control handle all the way up over the first point such that the E-liquid flow from the E-liquid storage tank to the E-liquid storage medium is completely shut down. When the user wishes to use the electronic cigarette, the user pushes the E-liquid flow control handle down and pass the first point such that the E-liquid flow from the E-liquid storage tank to the E-liquid storage medium is partially open. When the user pushes the E-liquid flow control handle all the way down to the second point, the E-liquid flow from the E-liquid storage tank to the E-liquid storage medium reaches maximum. The user adjusts the E-liquid flow control handle between the first point and the second point to perform E-liquid flow control.

These and other aspects of the present disclosure will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and, together with the written description, serve to explain the principles of the disclosure. Wherever possible, the same reference numbers are used throughout the drawings to refer to the same or like elements of an embodiment. The drawings do not limit the present disclosure to the specific embodiments disclosed and described herein. The drawings are not necessarily to scale, emphasis instead being placed upon clearly illustrating the principles of the disclosure, and wherein.

DETAILED DESCRIPTION

Figure 1:
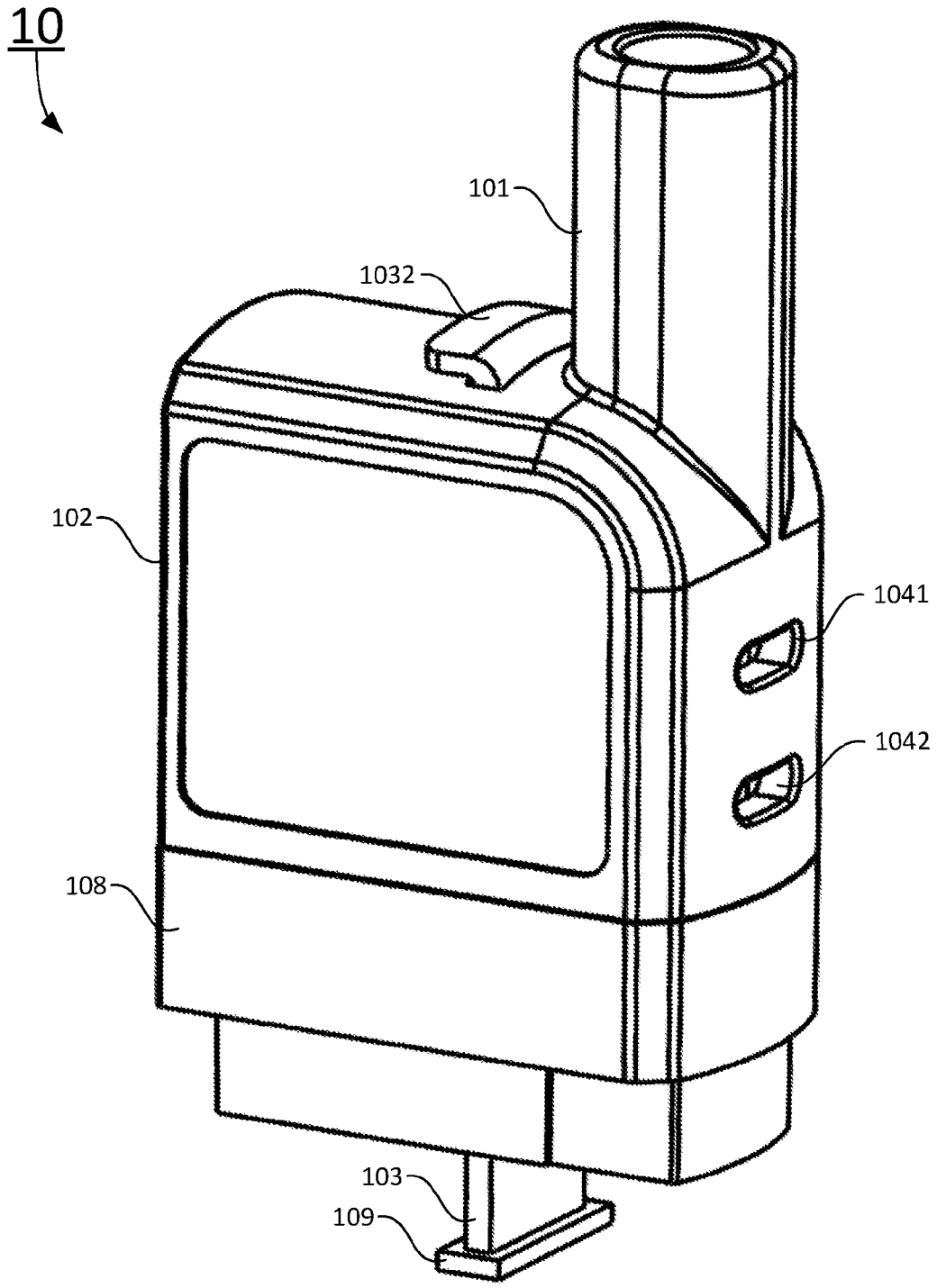
FIG. 1 is an external view of an exemplary electronic cigarette having an E-liquid flow control mechanism according to certain embodiments of the present disclosure.

The present disclosure will now be described more fully hereinafter with reference to the accompanying drawings, in which exemplary embodiments of the disclosure are shown. This disclosure may, however, be embodied in many different forms and should not be construed as limited to the embodiments set forth herein. Rather, these embodiments are provided so that this disclosure will be thorough and complete, and will fully convey the scope of the disclosure to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present disclosure.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," or "includes" and/or "including" or "has" and/or "having" when used herein, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom", "upper" or "top," and "front" or "back" may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around", "about" or "approximately" shall generally mean within 20 percent, preferably within 10 percent, and more preferably within 5 percent of a given value or range. Numerical quantities given herein are approximates, meaning that the term "around", "about" or "approximately" can be inferred if not expressly stated.

Many specific details are provided in the following descriptions to make the present disclosure be fully understood, but the present disclosure may also be implemented by using other manners different from those described herein, so that the present disclosure is not limited by the specific embodiments disclosed in the following.

The description will be made as to the embodiments of the present disclosure in conjunction with the accompanying drawings FIGS. 1 through 6.

Figure 2:
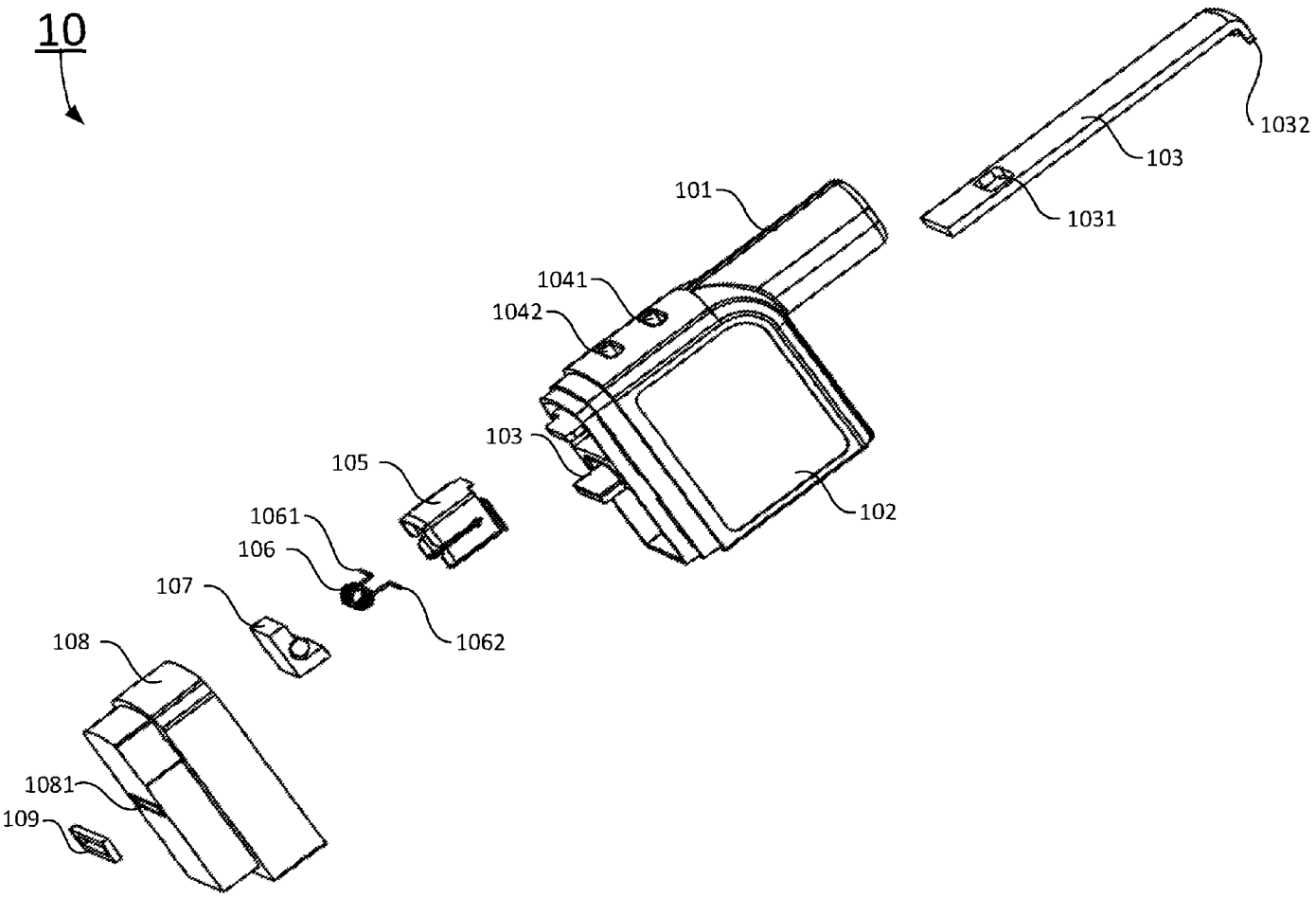
FIG. 2 is an exploded perspective view of the electronic cigarette having the E-liquid flow control mechanism according to certain embodiments of the present disclosure.
Figure 3:
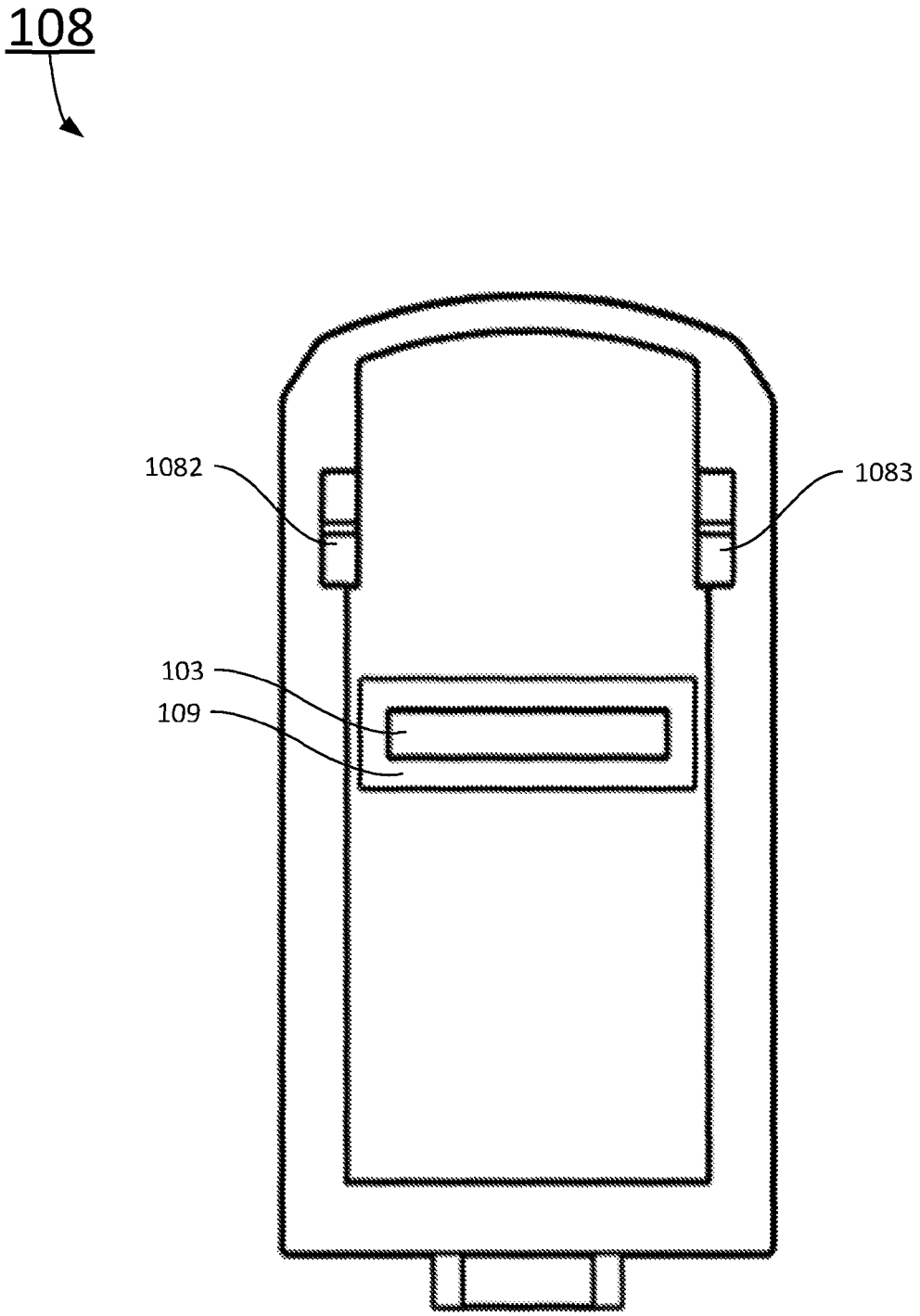
FIG. 3 is a bottom perspective view of the electronic cigarette having the E-liquid flow control mechanism according to certain embodiments of the present disclosure.

Referring now to FIGS. 1-3, in one aspect, the present disclosure relates to an electronic cigarette 10. In certain embodiments, the electronic cigarette 10 may include: an electronic cigarette body 102, a vaporizer 120, and an E-liquid flow control mechanism 103.

The electronic cigarette body 102 includes an E-liquid storage tank 1021 for storing E-liquid. In one embodiment, the E-liquid storage tank 1021 may be a disposable E-liquid storage tank filled with E-liquid. In another embodiment, the E-liquid storage tank 1021 may be a refillable E-liquid storage tank configured to be refilled when the E-liquid in the refillable E-liquid storage tank becomes low.

The electronic cigarette body 102 also includes a mouthpiece 101 positioned on a top end of the electronic cigarette body 102, and an electronic cigarette base 108 positioned at a bottom end of the electronic cigarette body 102.

The vaporizer 120 is positioned on a vaporizer base 105. The vaporizer 120 includes a heating element 106, and an E-liquid storage medium 107.

In certain embodiments, the heating element 106 includes a positive terminal 1061 electrically coupled to a positive terminal of the electrical power supply through a positive terminal 1082 of the electronic cigarette base 108, and a negative terminal 1062 electrically coupled to a negative terminal of the electrical power supply through a negative terminal 1083 of the electronic cigarette base 108, as shown in FIG. 3.

The heating element 106 may include: a grid shaped heating element, a mesh shaped heating element, a net shaped heating element, a spiral heating element, and any combination of these heating elements.

In certain embodiments, the E-liquid storage medium 107 may include: an "L" shaped the exterior wall facing the E-liquid flow control opening 1031 to receive the E-liquid from the E-liquid storage tank 1021, and a cylindrical center for installing the heating element 106.

In certain embodiments, the E-liquid storage medium 107 includes: cotton fibers, polypropylene fibers, terylene fibers, nylon fibers, and porous ceramic materials.

In certain embodiments, the E-liquid flow control mechanism 103 defines an E-liquid flow control opening 1031. The E-liquid flow control mechanism 103 has an E-liquid flow control handle 1032 on a top end of the E-liquid flow control mechanism 103. When the E-liquid flow control handle 1032 is lifted in an upper position, the E-liquid in the E-liquid storage tank 1021 is blocked by the E-liquid flow control mechanism 103. When the E-liquid flow control handle 1032 is pushed to a lower position, the E-liquid in the E-liquid storage tank 1021 flows into the E-liquid storage medium 107 to be vaporized by the heating element 106 through the E-liquid flow control opening 1031 of the E-liquid flow control mechanism 103.

In certain embodiments, an E-liquid flow control mechanism base 109 is installed at a lower end of the E-liquid flow control mechanism 103 to prevent the E-liquid flow control mechanism 103 from being pulled out of the electronic cigarette body 102.

In certain embodiments, the electronic cigarette base 108 may include a separation wall 1086 configured to separate the E-liquid storage tank 1021 and the vaporizer 120. The separation wall 1086 defines an E-liquid flow opening 1084 configured to supply the E-liquid in the E-liquid storage tank 1021 to the E-liquid storage medium 107 through the E-liquid flow opening 1084.

In certain embodiments, the "L" shaped the exterior wall of the E-liquid storage medium 107 is positioned at the E-liquid flow opening 1084 to prevent the E-liquid in the E-liquid storage tank 1021 from spilling out through the vaporizer 120.

Figure 4B:
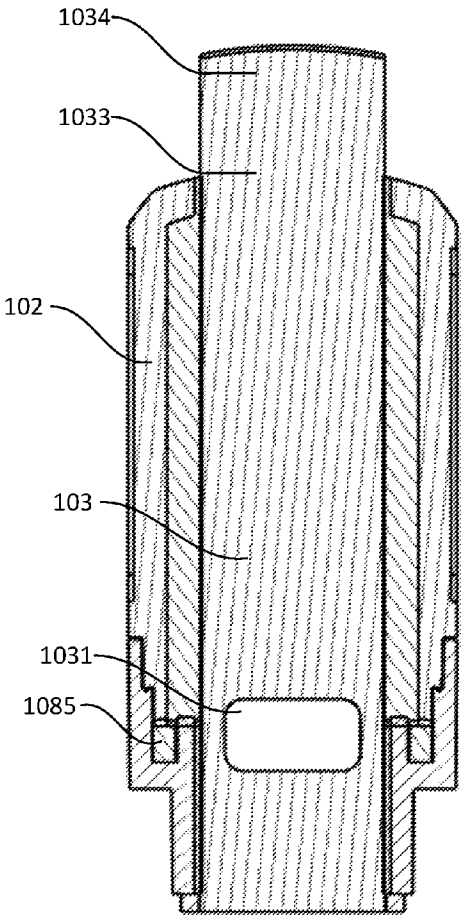
FIG. 4A is a detailed cross-sectional view of the electronic cigarette having the E-liquid flow control mechanism and FIG. 4B is a detailed cross-sectional view of the electronic cigarette along an E-liquid flow control handle when the E-liquid flow control handle is in a first point and E-liquid supply path is blocked according to certain embodiments of the present disclosure.
Figure 4A:
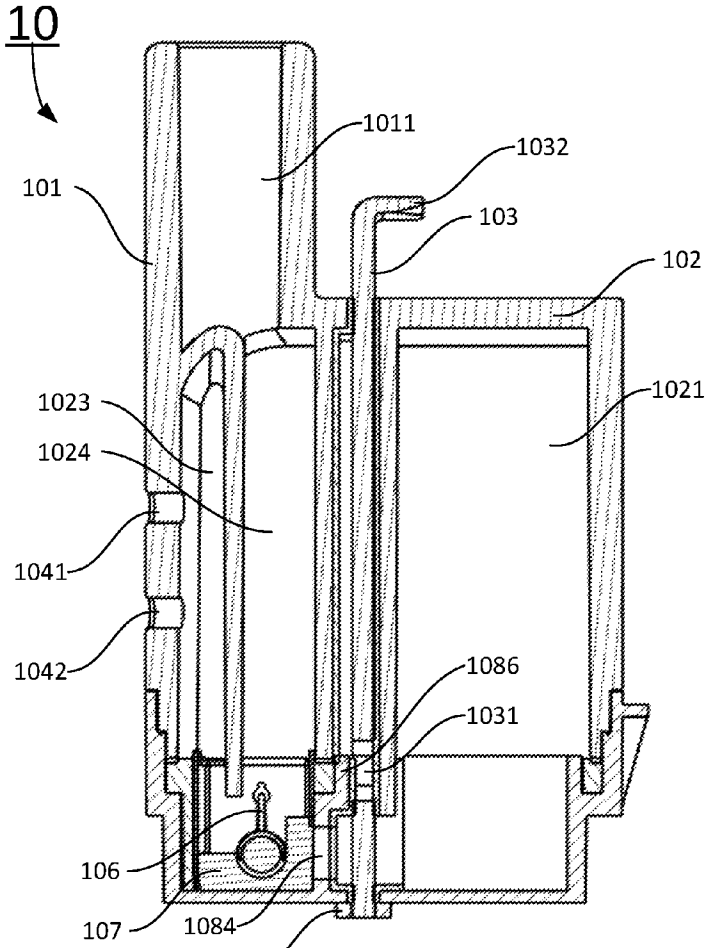

Referring now to FIGS. 4A and 4B, in certain embodiments, when the E-liquid flow control handle 1032 is pulled all the way up to show a first point 1033 as marked over the electronic cigarette body 102 in FIG. 4B, and the E-liquid flow control handle 1032 is stopped by the E-liquid flow control mechanism base 109, an E-liquid path from the E-liquid storage tank 1021 to the E-liquid storage medium 107 through the E-liquid flow opening 1084 is completely blocked.

Figure 5B:
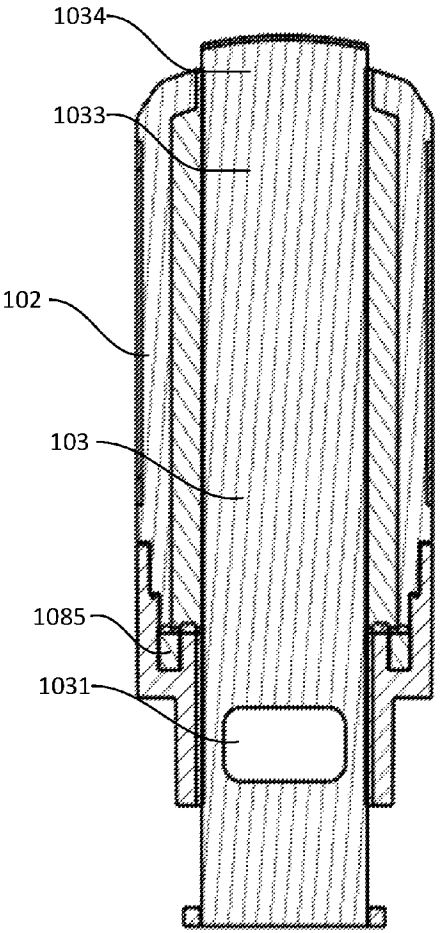
FIG. 5A is a detailed cross-sectional view of the electronic cigarette having the E-liquid flow control mechanism and FIG. 5B is a detailed cross-sectional view of the electronic cigarette along the E-liquid flow control handle when the E-liquid flow control handle is in a second point and E-liquid supply path is opened according to certain embodiments of the present disclosure.
Figure 5A:
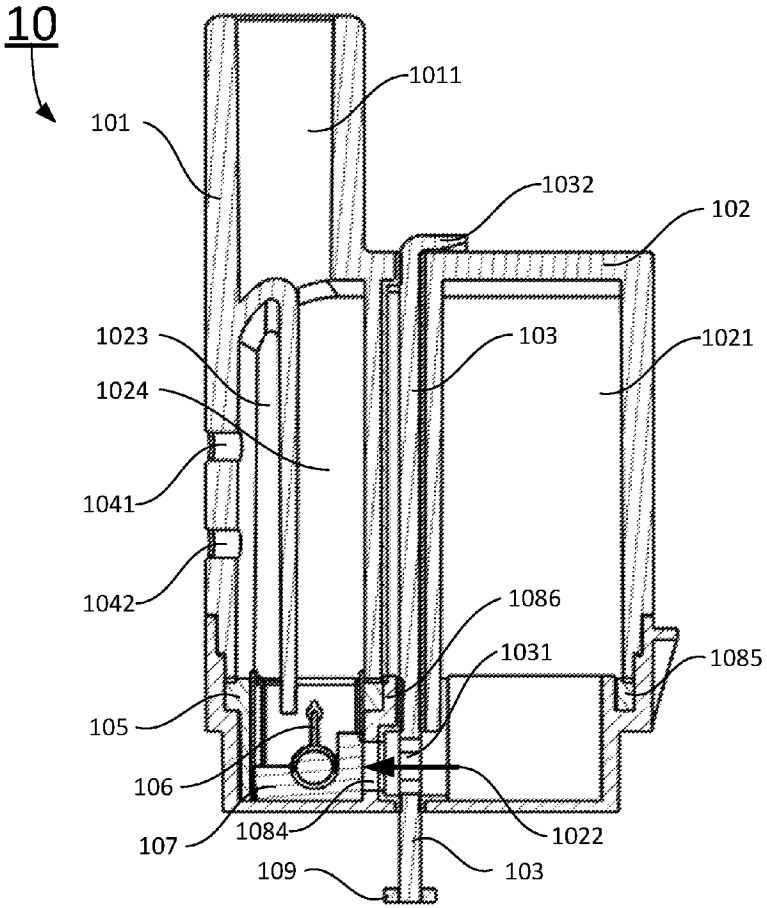

Referring now to FIGS. 5A and 5B, in certain embodiments, when the E-liquid flow control handle 1032 is pushed all the way down and the E-liquid flow control handle 1032 is stopped by the electronic cigarette body 102, an E-liquid path 1022 from the E-liquid storage tank 1021 to the E-liquid storage medium 107 through the E-liquid flow opening 1084 is completely opened.

When the E-liquid flow control handle 1032 is pushed down and the top of the electronic cigarette body 102 is between the first point 1033 and a second point 1034 as shown in FIG. 4B, the E-liquid path 1022 from the E-liquid storage tank 1021 to the E-liquid storage medium 107 through the E-liquid flow opening 1084 is partially opened. The user can control the flow of E-liquid over the E-liquid path 1022.

In certain embodiments, the first point 1033 and the second point 1034 are marked on the E-liquid flow control mechanism 103 such that a user uses the first point 1033 and the second point 1034 to perform E-liquid flow control.

In certain embodiments, the electronic cigarette body 102 defines a first air intake opening 1041 and a second air intake opening 1042 and forms an airflow path. When the user pushes down the E-liquid flow control handle 1032 of the E-liquid flow control mechanism 103 to allow the E-liquid in the E-liquid storage tank 1021 to flow into the E-liquid storage medium 107, turns on an electrical power supply and sucks from the mouthpiece 101, outside air flows through the first air intake opening 1041 and the second air intake opening 1042 into an air intake path 1023, goes down to the E-liquid storage medium 107 and the heating element 106, goes up through a vapor output path 1024, and finally exits from a vapor output tube 1011 of the mouthpiece 101.

In certain embodiments, the electronic cigarette body 102 is slidedly coupled to the electronic cigarette base 108. A sealing band 1085 is used to seal the connection between the electronic cigarette body 102 and the electronic cigarette base 108.

In another aspect, the present disclosure relates to a method of using an electronic cigarette 10. In certain embodiments, the method may include:

pushing down, by a user, an E-liquid flow control handler 1032 of an E-liquid flow control mechanism 103 to allow an E-liquid flow control opening 1031 of the E-liquid flow control mechanism 103 to partially overlap an E-liquid flow opening 1084 defined on a separation wall 1086 of an electronic cigarette base 108 to allow E-liquid stored in an E-liquid storage tank 1021 to flow to an E-liquid storage medium 107;

turning on, by the user, an electrical power supply to provide electrical power to a heating element 106 of a vaporizer 120 to vaporize the E-liquid flowed to the E-liquid storage medium 107; and sucking, by the user, E-liquid vapor from the vaporizer through a mouthpiece 101. Air outside of the electronic cigarette 10 enters an electronic cigarette body 102 through one or more air intake openings 104, an air intake path 1023. Then the air is be vaporized by the vaporizer 120, and the vapor formed by the vaporizer 120 exits through an vapor output path 1024 and the mouthpiece 101.

Figure 6:
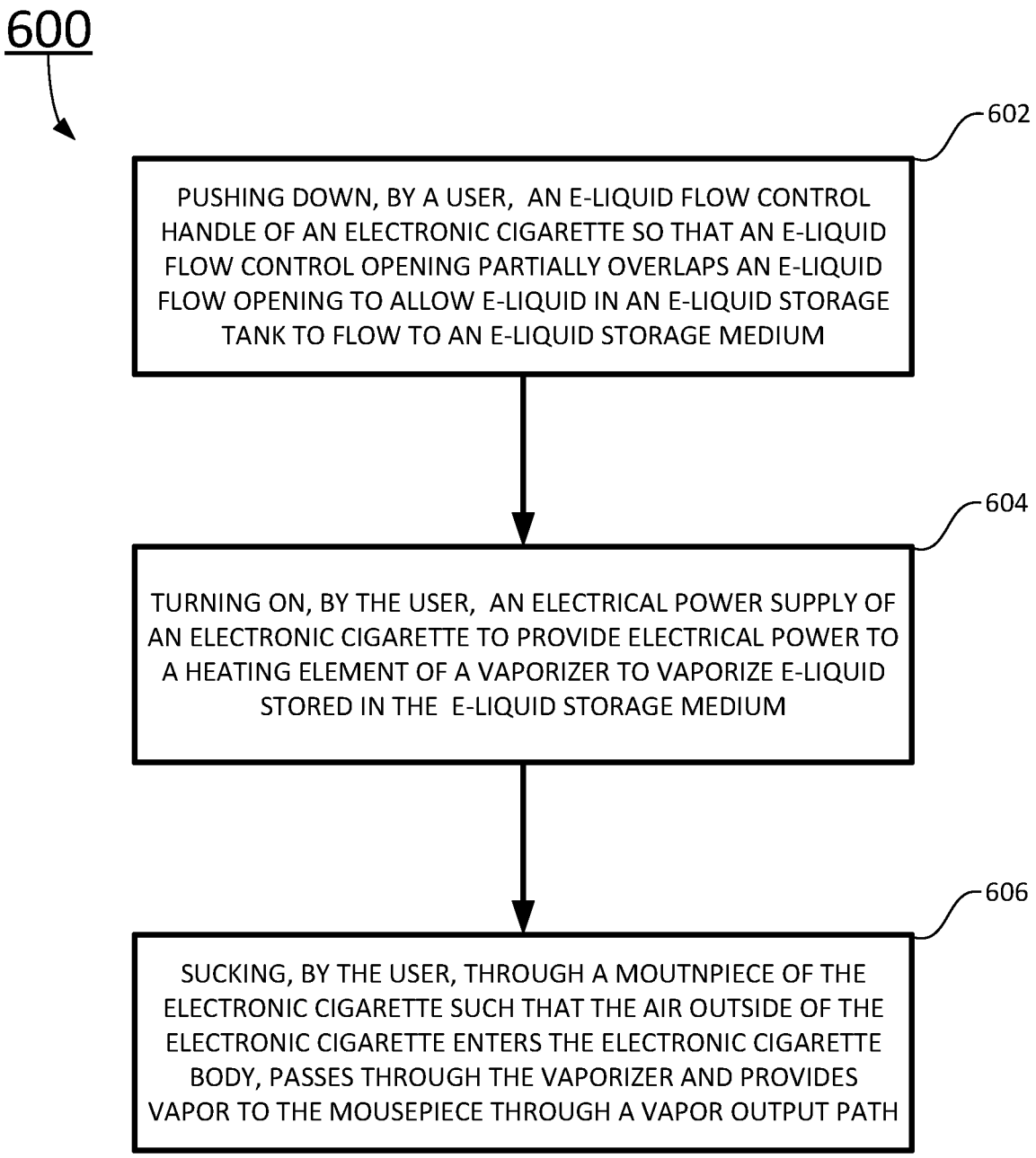
FIG. 6 is a flowchart of a method to use the electronic cigarettes having the E-liquid flow control mechanism according to certain embodiments of the present disclosure.

Referring now to FIG. 6, a flowchart of a method to use the electronic cigarette 10 having the E-liquid flow control mechanism 103 is shown according to certain embodiments of the present disclosure.

At block 602, the user may push down the E-liquid flow control handler 1032 of the E-liquid flow control mechanism 103 to allow the E-liquid flow control opening 1031 of the E-liquid flow control mechanism 103 to partially overlap an E-liquid flow opening 1084 defined on the separation wall 1086 of the electronic cigarette base 108 to allow E-liquid stored in the E-liquid storage tank 1021 to flow to the E-liquid storage medium 107.

When the user pushes the E-liquid flow control handler 1032 all the way down to the second point 1034, the E-liquid flow 1022 from the E-liquid storage tank 1021 to the E-liquid storage medium 107 reaches maximum. When the user wishes to adjust the E-liquid flow in the electronic cigarette 10, the user pushes down or pulls up the E-liquid flow control handler 1032 such that the top of the electronic cigarette body 102 is between the first point 1033 and the second point 1034 and the E-liquid flow 1022 from the E-liquid storage tank 1021 to the E-liquid storage medium 107 is partially open. The user adjusts the E-liquid flow control handler 1032 between the first point 1033 and the second point 1034 to perform E-liquid flow control.

In certain embodiments, when the user wishes to store the electronic cigarette and not to user it for a while, the user can put the electronic cigarette 10 in an airplane mode. The user pulls the E-liquid flow control handler 1032 all the way up over the first point 1033 such that the E-liquid flow from the E-liquid storage tank 1021 to the E-liquid storage medium 107 is completely shut down.

At block 604, the user turns on the electrical power supply to the electronic cigarette 10 to provide electrical power to the heating element 106 of the vaporizer 120 to vaporize the E-liquid stored in the E-liquid storage medium 107.

At block 606, the user sucks the mouthpiece 101 of the electronic cigarette 10. The air outside of the electronic cigarette 10 enters the electronic cigarette body 102 through the first air intake opening 1041, and the second air intake opening 1042, passes through the air intake path 1023, reaches the vaporizer 120. The vapor generated by the vaporizer 120 goes up through a vapor output path 1024 and goes to the user through vapor output tube 1011 of the mouthpiece 101.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to activate others skilled in the art to utilize the disclosure and various embodiments and with various modifications as are suited to the particular use contemplated. Alternative embodiments will become apparent to those skilled in the art to which the present disclosure pertains without departing from its spirit and scope. Accordingly, the scope of the present disclosure is defined by the appended claims, the foregoing description and the exemplary embodiments described therein, and accompanying drawings.

What is claimed is:

1. An electronic cigarette, comprising:

an electronic cigarette body having an E-liquid storage tank storing E-liquid, a mouthpiece positioned on a top end of the electronic cigarette body, and an electronic cigarette base positioned at a bottom end of the electronic cigarette body;

a vaporizer positioned on a vaporizer base, wherein the vaporizer comprises a heating element, and an E-liquid storage medium having an "L" shaped exterior wall facing the E-liquid flow control opening to receive the E-liquid from the E-liquid storage tank, and a cylindrical center for installing the heating element; and an E-liquid flow control mechanism defining an E-liquid flow control opening and having an E-liquid flow control handle on a top end of the E-liquid flow control mechanism, wherein when the E-liquid flow control handle is lifted all the way up to a first point, the E-liquid in the E-liquid storage tank is blocked by the E-liquid flow control mechanism, when the E-liquid flow control handle is pushed all the way down to a second point, the E-liquid in the E-liquid storage tank flows into the vaporizer to be vaporized, and when the E-liquid flow control handle is pushed down to a point between the first point and the second point, the E-liquid flow between the E-liquid storage tank and the E-liquid storage medium is controlled.

2. The electronic cigarette of claim 1, wherein the electronic cigarette base comprises:

a separation wall configured to separate the E-liquid storage tank and the vaporizer, wherein the separation wall defines an E-liquid flow opening configured to supply the E-liquid in the E-liquid storage tank to the E-liquid storage medium through the E-liquid flow opening.

3. The electronic cigarette of claim 2, wherein the "L" shaped exterior wall of the E-liquid storage medium is positioned at the E-liquid flow opening to prevent the E-liquid in the E-liquid storage tank from spilling out through the vaporizer.

4. The electronic cigarette of claim 2, wherein when the E-liquid flow control handle is pushed down to the first point, the E-liquid flow control opening of the E-liquid flow control mechanism overlaps the E-liquid flow opening partially to allow E-liquid in the E-liquid storage tank to flow to the E-liquid storage medium, and when the E-liquid flow control handle is pushed down to the second point, the E-liquid flow control opening of the E-liquid flow control mechanism overlaps the E-liquid flow opening entirely to allow maximum E-liquid flow from the E-liquid storage tank to the E-liquid storage medium.

5. The electronic cigarette of claim 4, wherein the first point and the second point are marked on the E-liquid flow control mechanism such that a user uses the first point and the second point to perform E-liquid flow control.

6. The electronic cigarette of claim 5, wherein the electronic cigarette body defines a first air intake opening and a second air intake opening and forms an airflow path, when the user pushes down the E-liquid flow control handle of the E-liquid flow control mechanism to allow the E-liquid in the E-liquid storage tank to flow into the E-liquid storage medium, turns on an electrical power supply and sucks from the mouthpiece, outside air flows through the first air intake opening and the second air intake opening into an air intake path, goes down to the E-liquid storage medium and the heating element, goes up through a vapor output path, and finally exits from a vapor output tube of the mouthpiece.

7. The electronic cigarette of claim 6, wherein the heating element comprises a positive terminal electrically coupled to a positive terminal of an electrical power supply through a positive terminal of the electronic cigarette base, and a negative terminal electrically coupled to a negative terminal of the electrical power supply through a negative terminal of the electronic cigarette base.

8. The electronic cigarette of claim 1, wherein the heating element comprises:

a grid shaped heating element;

a mesh shaped heating element;

a net shaped heating element;

a spiral heating element; and any combination thereof.

9. The electronic cigarette of claim 1, wherein the E-liquid storage medium comprises:

cotton fibers;

polypropylene fibers;

terylene fibers;

nylon fibers; and porous ceramic materials.

10. The electronic cigarette of claim 1, wherein the electronic cigarette body is slidedly coupled to the electronic cigarette base.

11. The electronic cigarette of claim 10, wherein a sealing band is used to seal the connection between the electronic cigarette body and the electronic cigarette base.

12. The electronic cigarette of claim 1, wherein an E-liquid flow control mechanism base is installed at a lower end of the E-liquid flow control mechanism to prevent the E-liquid flow control mechanism from being pulled out of the electronic cigarette body.

13. The electronic cigarette of claim 1, wherein the E-liquid storage tank is a disposable E-liquid storage tank.

14. The electronic cigarette of claim 1, wherein the E-liquid storage tank is a refillable E-liquid storage tank.

15. A method of using an electronic cigarette comprising:

pushing down, by a user, an E-liquid flow control handle of an E-liquid flow control mechanism to allow an E-liquid flow control opening of the E-liquid flow control mechanism to partially overlap an E-liquid flow opening defined on a separation wall of an electronic cigarette base to allow E-liquid stored in an E-liquid storage tank to flow to an E-liquid storage medium, wherein an E-liquid flow control mechanism base is installed at a lower end of the E-liquid flow control mechanism to prevent the E-liquid flow control mechanism from being pulled out of the electronic cigarette body;

turning on, by the user, an electrical power supply to provide electrical power to a heating element of a vaporizer to vaporize the E-liquid flowed to the E-liquid storage medium; and sucking, by the user, E-liquid vapor from the vaporizer through a mouthpiece, wherein air outside of the electronic cigarette enters an electronic cigarette body through one or more air intake openings, an air intake path, to be vaporized by the vaporizer, and the vapor formed by the vaporizer exits through a vapor output path and the mouthpiece.

16. The method of claim 15, wherein the E-liquid storage tank comprises:

a disposable E-liquid storage tank filled with E-liquid; and a refillable E-liquid storage tank configured to be refilled when the E-liquid in the refillable E-liquid storage tank becomes low.

17. The method of claim 15, wherein a first point and a second point are marked on the E-liquid flow control mechanism such that the user uses the first point and the second point to perform E-liquid flow control.

18. The method of claim 17, wherein when the user wishes to put the electronic cigarette in an airplane mode, the user pulls the E-liquid flow control handle all the way up over the first point such that the E-liquid flow from the E-liquid storage tank to the E-liquid storage medium is completely shut down.

19. The method of claim 17, wherein when the user wishes to use the electronic cigarette, the user pushes the E-liquid flow control handle down and pass the first point such that the E-liquid flow from the E-liquid storage tank to the E-liquid storage medium is partially open, when the user pushes the E-liquid flow control handle all the way down to the second point, the E-liquid flow from the E-liquid storage tank to the E-liquid storage medium reaches maximum, and the user adjusts the E-liquid flow control handle between the first point and the second point to perform E-liquid flow control.

* * * * *